United States Patent [19]

Cantella

[11] 4,302,998

[45] Dec. 1, 1981

[54] FAST OPERATION DEVICE FOR THE HEAD IN DIE-CUTTING MACHINES, PARTICULARLY FLAG TYPE

[75] Inventor: Emiliano Cantella, Vigevano, Italy

[73] Assignee: Atom S.p.A., Vigevano, Italy

[21] Appl. No.: 150,943

[22] Filed: May 19, 1980

[30] Foreign Application Priority Data

Jun. 29, 1979 [IT] Italy ..... 24019 A/79

[51] Int. Cl.[3] ..... B26D 5/12

[52] U.S. Cl. ..... 83/524; 83/535; 83/617; 83/639

[58] Field of Search ..... 83/524, 533, 531–538, 83/527–530, 617, 639; 72/28–30, 453.18

[56] References Cited

U.S. PATENT DOCUMENTS

| | | | |
|---|---|---|---|
| 2,792,883 | 5/1957 | Pokorski | 83/524 |
| 3,171,318 | 3/1965 | Muhlbach | 83/530 |
| 3,174,377 | 3/1965 | Lischer | 83/530 X |
| 3,474,695 | 10/1969 | Longval | 83/524 |
| 3,854,362 | 12/1974 | Cantella | 83/533 X |

*Primary Examiner*—Frank T. Yost

*Attorney, Agent, or Firm*—Browdy and Neimark

[57] ABSTRACT

Fast head operating device for flag type die-cutting machines, comprising a hydraulic circuit with one end connected to a feed pump and the other to two cylindrical chambers defined at the base of a column supporting the head of the die-cutting machine, the hydraulic circuit comprising a control valve, equipped with a seal which slides into and is engaged in the body of the same valve to form a fluid communication between a feed conduit and a first inlet conduit, which flows into one of said cylindrical chambers for the rise of the column and with a second inlet conduit which flows into the other cylindrical chamber for the downstroke of the above-mentioned column. Interposed on said first inlet conduit, a sequence valve is provided while a further fluid conduit branching from the second inlet conduit, flows into a cylindrical chamber into which a small piston slides and is engaged, carrying, at the opposite end, the mobile contact of a pressure switch connected to the electric operating device.

6 Claims, 7 Drawing Figures

FAST OPERATION DEVICE FOR THE HEAD IN DIE-CUTTING MACHINES, PARTICULARLY FLAG TYPE

This invention refers to a fast operation device for the head in die-cutting machines, particularly flag type, comprising a hydraulic circuit with one end connected to a feed pump and the opposite end to two cylindrical chambers defined at the base of a column supporting the head of the die-cutting machine, a control valve being foreseen in said hydraulic circuit, interlocked to electric operating means, equipped with a seal member sliding into and engaged in the body of said valve to communicate the fluid in a feed conduit with a first inlet conduit which flows into one of said cylindrical chambers for the rise of the column carrying the head of the die-cutting machine, and with a second inlet conduit flowing into the other cylindrical chamber for the downstroke of the above-mentioned column.

A flag type die-cutting machine is mainly composed of a base, on which a work level is formed, and a side upright into which a column slides and is engaged, carrying, at its upper end, the head of the die-cutting machine on its striking surface. The control devices which raise and lower the heads of die-cutting machines normally consist in a hydraulic circuit filled through a feed pump with working fluid, which, entering a conduit in a control valve, is communicated by same to at least two conduits which flow into a first and second cylindrical chamber at the base of the abovementioned column. The control valve is operated by an electric circuit which, energizing an electromagnet, provokes movement of the seal member located inside the valve body to open and/or close the abovementioned inlet conduits according to the operation required from the die-cutting machine.

One of the major drawbacks in a flag type die-cutting machine, which has a negative effect on the productivity of any company using these machines, is the dead time created in the head downstroke and rise phases. In reality, since the cutting phase is the working phase of the die-cutting machine, other dead times exist, e.g. angular head displacements nearer or further away from the hollow punch and the time required for the operator to replace the piece of leather cut with a new piece. Strictly speaking, also the dead time for head lifting may be considered inevitable, if one considers that, during the flag lifting phase, the operator is completely free to rotate same in the direction in which the hollow punch is moved away.

Therefore, if it is desired to reduce the dead times of the die-cutting machine, it is fundamental to reduce the time taken to lower the head on the hollow punch. Another "insito" drawback in control devices in known die-cutting machines is the need to provide an end of stroke for each type of hollow punch used, i.e. a suitable end of stroke for the height of the hollow punch used. In fact, when lower hollow punches are used after higher hollow punches or viceversa, the flag must be preadjusted each time by means of a potentiometer provided in the electric control circuit. If this is not preadjusted and a lower hollow punch used after a high one, cutting will not be complete, while, viceversa, if a higher hollow punch is used after a low one, after the leather has been cut, the hollow punch would be driven into the block normally provided on the work level. One of the main purposes of this invention is to overcome the abovementioned drawbacks by constructing a fast head operating device for die-cutting machines, particularly flag type, which makes it possible, when the head is lowered, to find the hollow punch immediately, independent of its height, thus eliminating the abovementioned ends of stroke.

These and other purposes, which will appear clearer from the following description, are achieved, in accordance with this invention, by a fast head operating device for die-cutting machines, particularly flag type, characterized by the fact that it comprises a sequence valve, interposed on said first inlet conduit, a further fluid conduit branching from said second inlet conduit, immediately upstream from the respective cylindrical chamber, this further conduit flowing into a cylindrical chamber into which a small piston slides and is engaged, carrying, at its opposite end, the mobile contact of a pressure switch connected with said electric operating means. To its advantage, the sequence valve comprises a seal which slides into and is engaged in a respective valve body to open said first inlet conduit to the relevant cylindrical chamber and to interrupt the feed to said chamber, sending the working fluid in the first inlet conduit to discharge, the upper part of said seal containing a blind hole in which a return spring is located and into which a branch of the first inlet conduit, provided upstream from the sequence valve, flows, said seal and said valve body defining, at the base of the actual seal, a cylindrical chamber placed in fluid connection with the control valve by means of conduit which flows into the control valve body at the height of the second inlet conduit.

To its advantage, and in accordance with another feature of this invention, said cylindrical chamber, defined by the sequence valve body and the relevant seal, has a greater working thrust surface on the seal than that provided in correspondence with said blind hole.

The consequent advantages with the abovementioned device make it possible firstly to increase the production capacity of the die-cutting machine, thanks to an increased speed of the head downstroke on the hollow punch. In this connection, it should be noted that, thanks to the presence of the pressure switch connected to the electric control circuit, after rapidly moving the head near the hollow punch, the striking surface rests smoothly on the hollow punch with a slightly lower cutting.

Another advantage of the device in this invention regards the hydraulic pressure in the various conduits, which is less than the corresponding pressure in the hydraulic circuits in known types of die-cutting machines. This makes it possible to work with less stress and use smaller pumps and propulsors with consequent economic advantages.

Finally, it should be noted that, with the abovementioned device, a die-cutting machine need no longer be adjusted at end of stroke whenever the type of hollow punch to be used is changed.

Further features and advantages will appear clearer from the detailed description of a fast head operating device for die-cutting machines, particularly flag type, according to this invention, given below with reference to the attached drawings by way of example, but not limitatively, where:

Figure 1:
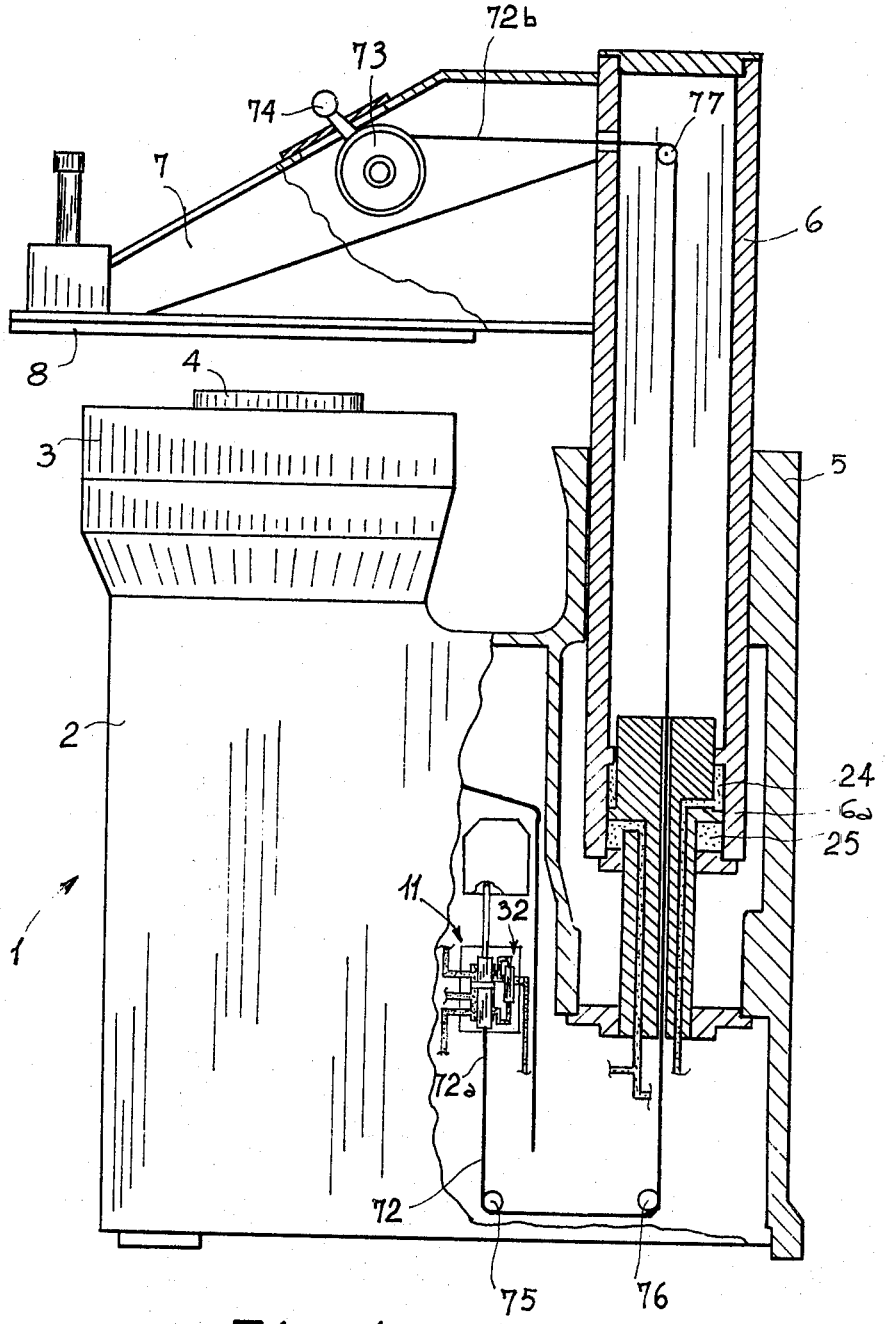
FIG. 1 shows a partially cutaway side view of the die-cutting machine equipped with the fast operating device in this invention.

In these drawings, particularly the first, the number 1 indicates a flag type die-cutting machine, mainly composed of a base 2, on top of which a work level is located upon which the sheet material is arranged, e.g. shoe leather, and a hollow punch 4 used to cut the material. An upright 5 rises in the lower part of the base 2, into which a column 5 slides and is engaged, which supports a head 7 on its protruding section, with a striking surface 8 at its base.

The head 7 can rotate around the axis of the column 6 and move vertically to approach or move away from the hollow punch 4 by means of an operating device, a schematic diagram of its various phases being shown in FIGS. 2 to 5, mainly composed of a hydraulic circuit always indicated with number 9. One end of this hydraulic circuit 9 is connected to a feed pump 10 and the opposite end to the base 6*a* of the column 6 which supports the head of the die-cutting machine.

A control valve is provided in the hydraulic circuit 9, always indicated with number 11, which is driven by electric means 12 and is equipped with a seal 13 which slides into and is engaged in a valve body 14 to place a feed conduit 15 coming from the pump 10 in fluid connection with a first inlet conduit 16 and a second inlet conduit 17, which flow into the base 6*a* of the column 6.

Figure 7:
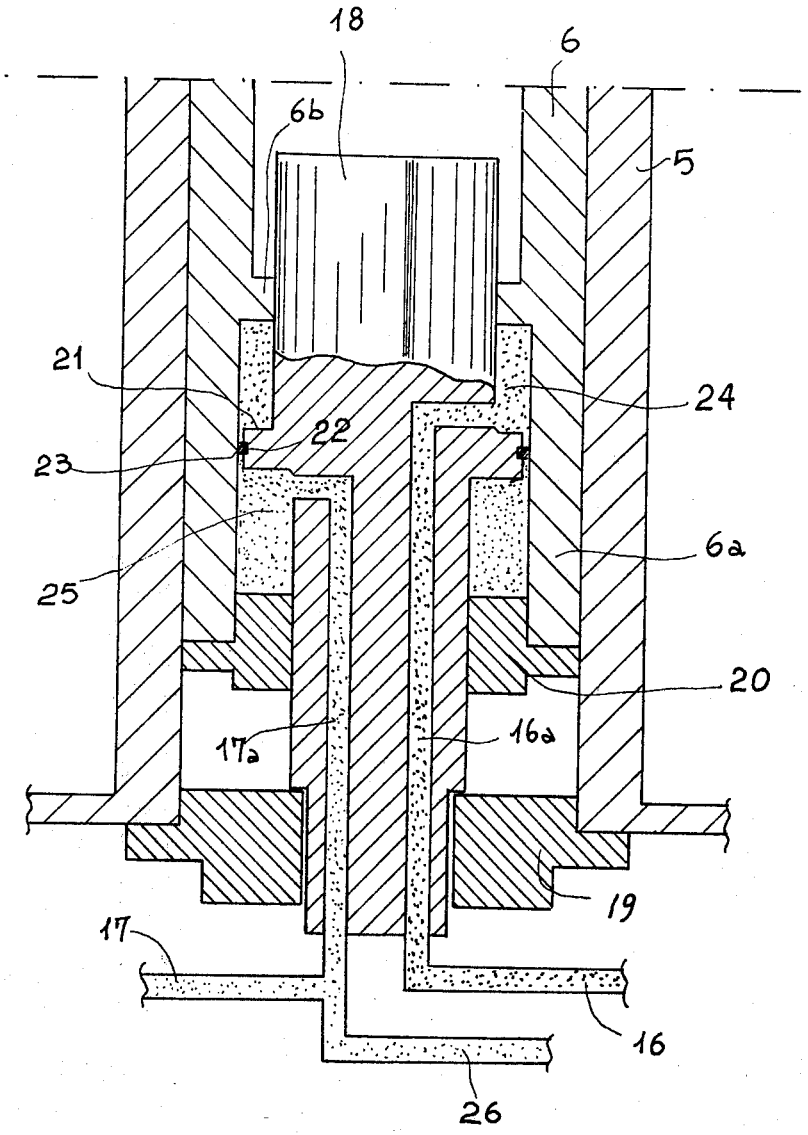
FIG. 7 is an enlargement of the cylindrical chambers built at the base of the column carrying the head.

The column 6 shown in FIG. 7 is hollow and its base 6*a* presents an inside annular protrusion 6*b* which slides into and is engaged, sealed on a piston 18 tightly connected by means of a flange or similar 19, in the upright 5 of the die-cutting machine.

At the foot of the base 6*a* of the column 6 is a mainly disk-shaped closing element 20, equipped with a centre hole to permit the column 6 to slide along the body of the piston 18, while, in a position between the inside annular protrusion 6*b* and this closing element 20, the piston 18 has an outside annular protrusion 21 within which there is a slot 22 to hold an annular seal gasket 23. Therefore, with the inside annular protrusion 6*b* and the closing element 20, the protrusion 21 thus defines an upper and a lower cylindrical chamber respectively.

The second inlet conduit 17 flows into the lower cylindrical chamber 25 through an end section 17*a* axially machined in the body of the piston 18, parallelly to the end section 17*a*.

Note that the cylindrical chamber 25 presents a larger working thrust surface on the column 6 than that provided in the cylindrical chamber 24.

Immediately upstream from the end section 17*a*, the second inlet conduit 17 has a branch 26 which flows into a cylindrical chamber 27 in the body of a pressure switch 28. A small piston 29 slides into and is engaged in the cylindrical chamber 27, coaxially extended to one end of a rod 30, carrying, at its free end, a mobile contact 31 of the pressure switch 28.

On the first inlet conduit 16 it is instead foreseen to insert a sequence valve 32, mainly composed of a valve body 33 into which a seal 34 slides and is engaged. In the attached drawings the valve body 33 is produced in one piece with the valve body 14 of the control valve 11, but the abovementioned bodies 14 and 33 may be kept separate if required.

Figure 6:
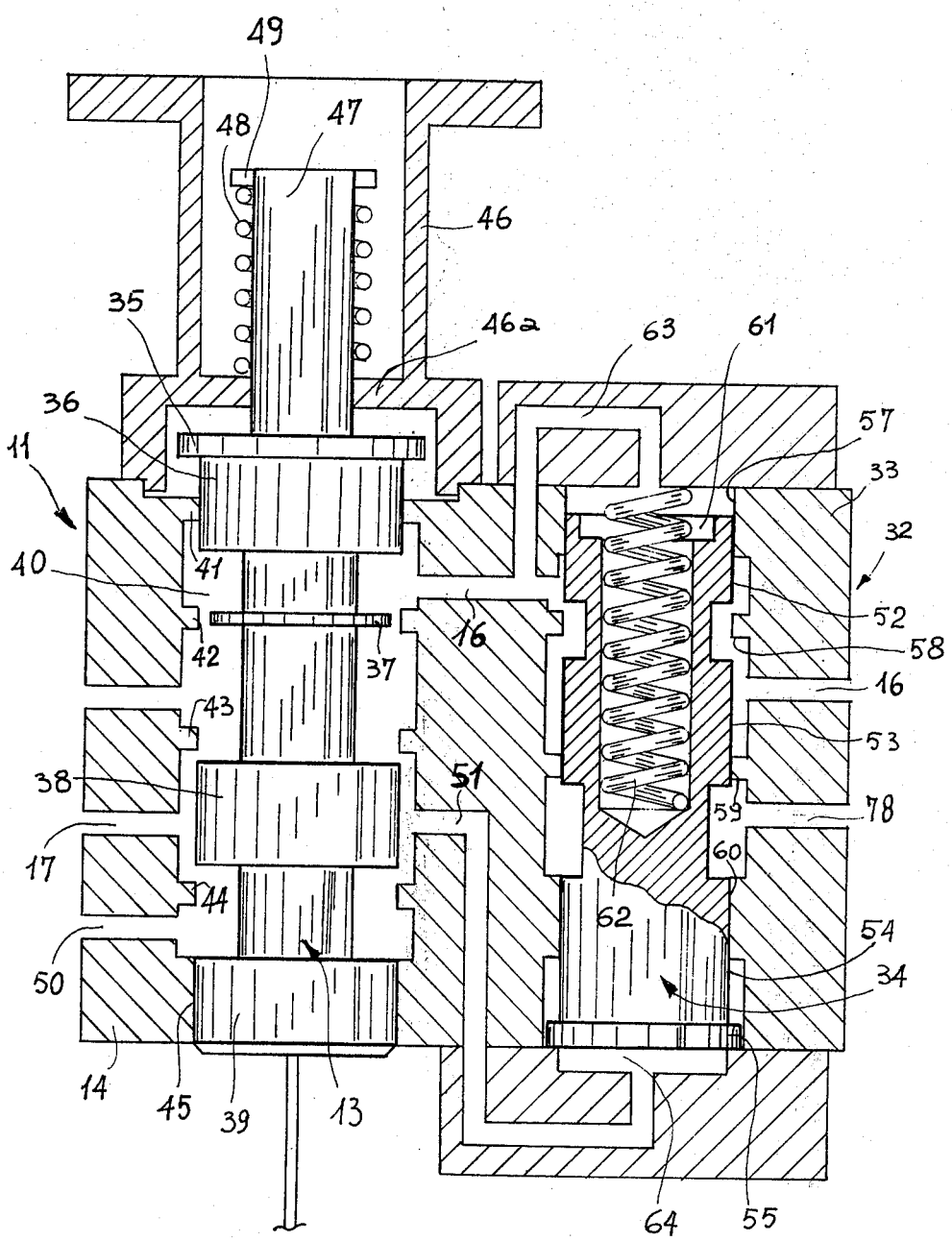
FIG. 6 is an enlarged cutaway view of the control valve and sequence valves.

In FIG. 6 the seal 13 of the control valve 11 mainly consists in a small cylindrical shaft with a large number of annular protrusions, indicated with numbers 35 to 39, located in a substantially cylindrical hole 40 in the body 14 of the control valve 11. Annular protrusions of the body of valve 14, indicated with numbers 41 to 45, protrude from the cylindrical hole 40. On top of the body of valve 14 is a hollow closing element 46, inside which is an annular portion 46*a* in which a shank 47 machined to extend the seal 13 can slide.

A return spring is wound around the shank 47 and is kept in position by a nut 49 screwed on the free end of said shank.

In the body of the valve 14 are also a discharge conduit 50 and a conduit 51 at the same height as the second inlet conduit 17, described in detail below.

Also in FIG. 6, the seal 34 of the sequence valve 32 is mainly composed of a small cylindrical shaft with a large number of annular protrusions, indicated with numbers 52 to 55, and is housed in a substantially cylindrical hole 56 of the valve body 33. This hole is equipped with a large number of annular protrusions, indicated with numbers 58 to 60, to determine, during axial displacement of the seal 34, combinations which make it possible to open and close the passage of the working fluid. On top of the seal 34 is a blind hole 61 in which a return spring 62 is housed. A branch 63 flows into the blind hole 61, provided on the first inlet conduit 16, in its section upstream from the sequence valve 34. The lower sections of the seal 34 and the valve body 33 form a cylindrical chamber 64 which is fluidly connected to the control valves 11 through the abovementioned conduit 51.

It should be noted that the cylindrical chamber 64 presents a larger working thrust surface on the seal 34 than that on the upper section of the same seal corresponding to the abovementioned blind hole 61.

The electrical means 12 to operate the control valves 11 are mainly composed of a pushbutton 65 which closes an electric circuit 6 on which an electromagnet 67 is located, which, when energized, causes axial displacement of the seal 34 in the control valve 11. The electric circuit 66 also includes a relay 87 to interrupt the actual circuit when an electric signal reaches this relay from the end of stroke pressure switch. The possibility is foreseen of this electric signal being delayed by a preadjustable potentiometer 68.

In other words, the electric circuit 66 is connected in 69 to a fixed contact 70 of the end of stroke pressure switch 28, while the relevant mobile contact 31 is connected to the electric circuit 66 in 71.

Finally, it should be noted that, in FIG. 1, when the electromagnet 67 is de-energized to the head 7 of the die-cutting machine 1, the upstroke of the same head is stopped by the seal 13 by means of a cable 72, one end of which is fixed to the base of the seal 13 and the opposite end fixed inside the winding race of a braking pulley 73 arranged revolvingly on the base 2, and a return pulley 77 arranged revolvingly on the column 6, correspondingly to its upper end. When the operating handle is hand-turned, the head 7 of the die-cutting machine is lowered or raised, as required.

The function of the die-cutting machine illustrated above will now be described, first referring to FIG. 2 which corresponds to the inoperative state, where the flag is in the supporting phase. It may be seen from this figure that the feed pump 10 sends the working fluid to the cylindrical chamber 24 to create a pressure which first lifts the column 6, and, once it has reached its preestablished position, keeps it balanced on a fluid cushion.

Through the feed conduit 15 the fluid enters the control valve 11 and from here is sent to the discharge conduit 50, through a self-adjusted throttling, to allow the fluid in the small cylindrical chamber 24 to maintain a pressure suitable to support the flag. As regards the sequence valve, the thrust on the upper and lower surfaces of the seal 34 are also balanced, as the size of the working thrust surfaces are offset by the presence of the spring 62. As may be seen from FIG. 6, in this phase the protrusion of the seal 34 and the annular protrusion 59, provided in the valve body 33, create a closing which prevents the working fluid flowing through the discharge conduit 78.

Figure 3:
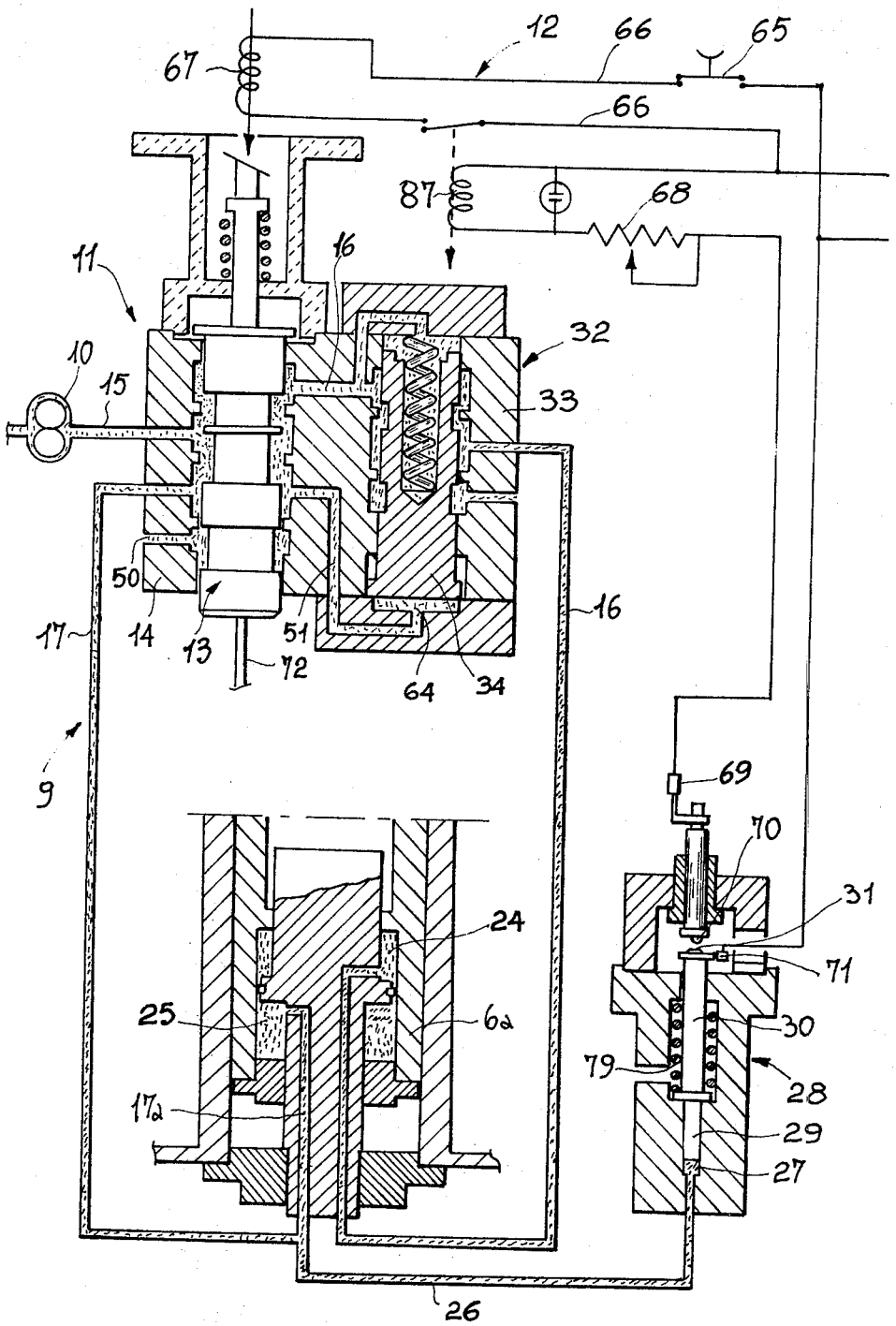
FIG. 3 is a schematic view of the abovementioned device during the approach phase of the fast head to the hollow punch.
Figure 4:
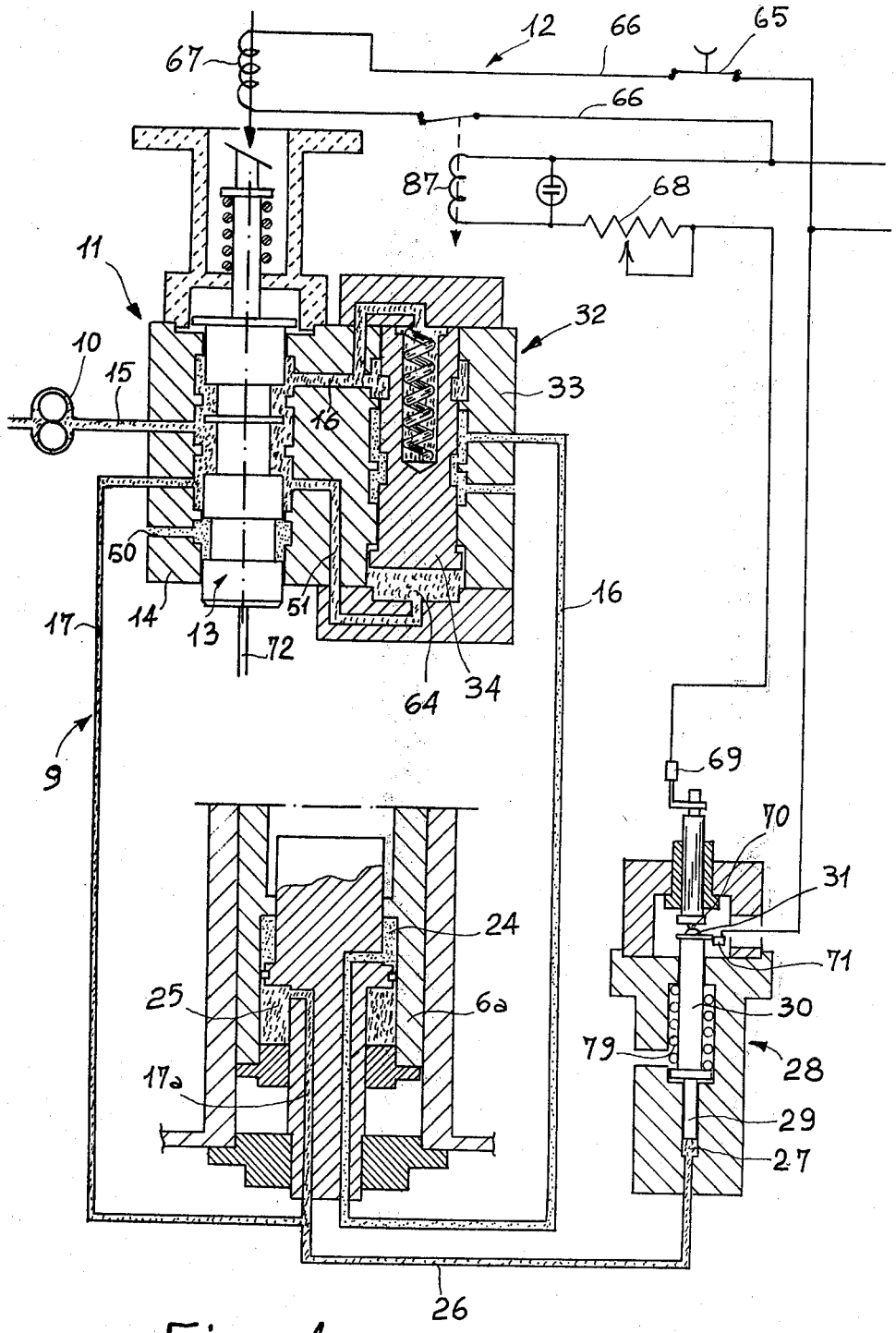
FIG. 4 shows the device in the previous FIG. 1 during cutting.

In FIG. 3, the fast approach of the head 7 to the hollow punch 4 is operated by pressing the pushbutton 65 which closes the circuit 66, permitting pickup of the electromagnet 67. The seal 13 of the control valve 11 is thus pushed down, carrying the annular protrusion 38 of same to correspond to the annular protrusion 44 obtained in the valve body 14, thus forming a closing which prevents the working fluid coming out of the discharge conduit 50 pressurizing the entire hydraulic circuit 9. In this way, a pressure is established in the cylindrical chambers 24 and 25 which, contrary to the working thrust surfaces, leads to lowering of the column 6 supporting the head 7 of the die-cutting machine. During this phase, the fluid in the chamber 24 is thrust backwards along the first inlet conduit 18 and substantially contributes to increasing the capacity of the fluid in the second inlet conduit 17, being added to the capacity of the pump 10, and therefore in the relevant cylindrical chamber 25. The constant pressure should also be noted of the pressure in the cylindrical chamber 27 of the end of stroke pressure switch 28, these being parallelly connected to the first inlet conduit 17.

When the striking surface of the head 7 of the die-cutting machine meets a resistance, due, for example, to the presence of the hollow punch 4 with the relevant material to be cut, the pressure inside the hydraulic control circuit increases, causing upward movement of the seal 34 of the sequence valve 32. In fact, as mentioned previously, since the working thrust surface of this seal is greater on its base than that foreseen above, due to differences in area, the abovementioned seal is moved upwards, thus freeing the discharge conduit 78 which allows the working fluid contained in the first inlet conduit 16 and the cylindrical chamber 28 to flow from same.

At the same time, due to the increased pressure in the hydraulic control circuit and therefore in the first inlet conduit in the end of stroke pressure switch 28, the small piston 29 and therefore the rod 30 carrying the mobile contact 31 are displaced upwards through the branch 26. As soon as the fixed contact 70 touches the mobile contact 31, the end of stroke pressure switch 28 emits an electric signal, which, delayed by the preadjustable potentiometer 68, reaches the relay 87 to open the electric circuit 66. Favourably, during the previous phase, at circuit opening, the head 7 of the die-cutting machine 1 continues to be lowered at a much lower speed than that at which the head 7 approaches the hollow punch 4, as the cylindrical chamber 25 remains without the fluid in the chamber 24. This makes it possible to obtain more efficient, accurate cutting. The above situation corresponds to the illustration in FIG. 4.

Figure 5:
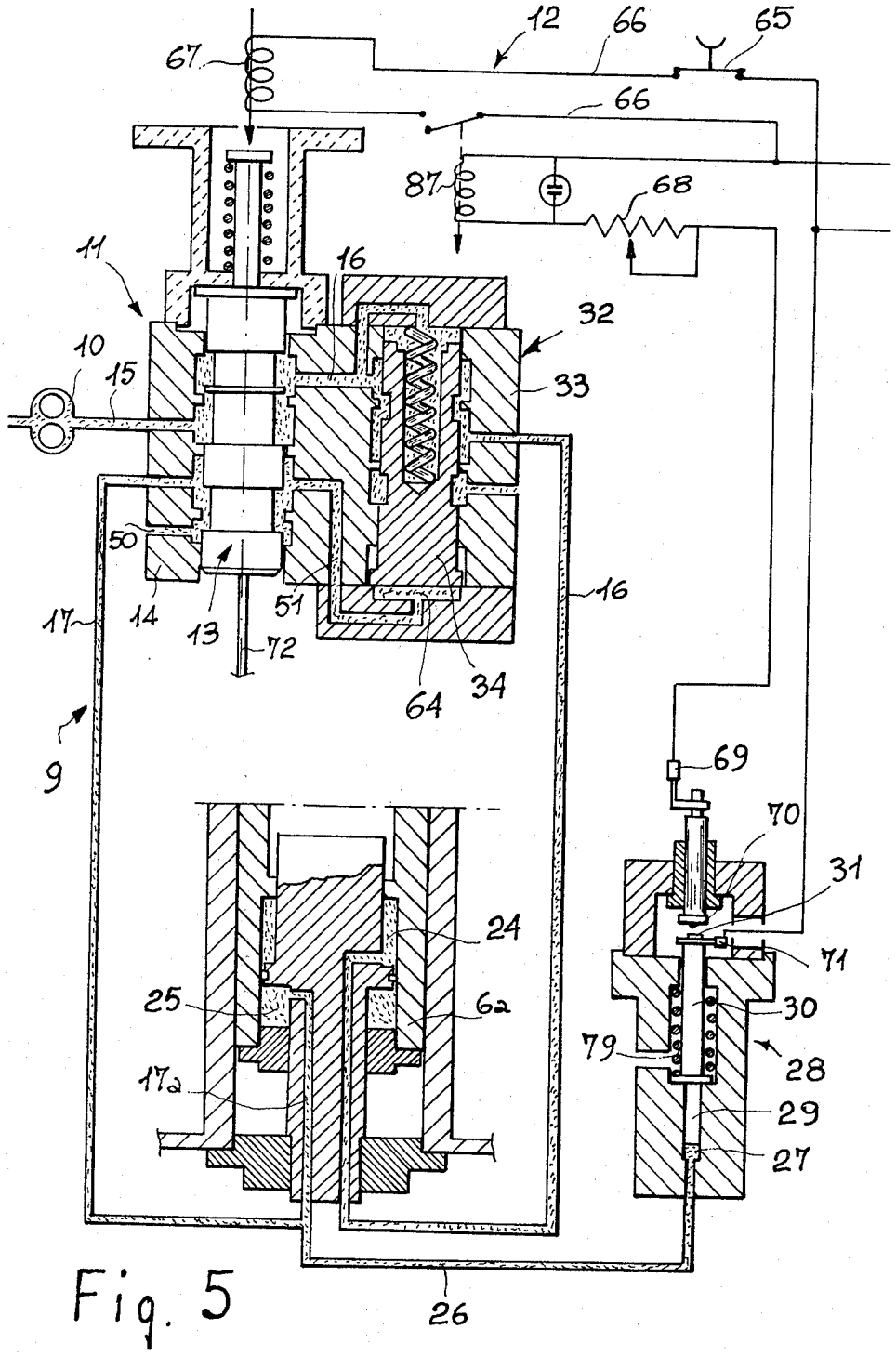
FIG. 5 is a schematic diagram of the abovementioned device during the flag return phase

In FIGS. 5 and 6, when the electric signal delayed by the potentiometer 68 reaches the relay 87, through the opening of the electric circuit 66, the electromagnet 67 is de-energized, which allows the return spring 48 to bring the seal 13 of the control valve 11 upwards again. The annular protrusion 38 of the seal 13 and the annular protrusion 43 thus form a closing which prevents the feed of the working fluid to the second inlet conduit 17. At the same time, the discharge conduit 50 remaining open, the fluid in the second inlet conduit flows to discharge, provoking a fall in pressure which causes lowering of the seal 34 of the sequence valve 32. When lowered, this seal causes the discharge conduit 78 to close and the first inlet conduit 16 to open, through which the working fluid is send under pressure to the cylindrical chamber 24. The column 6 supporting the head 7 is subsequently lifted to return the head to the lifting position. It should also be noted that in this phase the fall in pressure in the second inlet conduit 17 is identically translated in the branch 25, allowing a return spring 79, provided in a suitable slot in the body of the end of stroke pressure switch 28, to move the rod 30 downwards with consequent detachment of the mobile contact 31 from the fixed contact 70.

Figure 2:
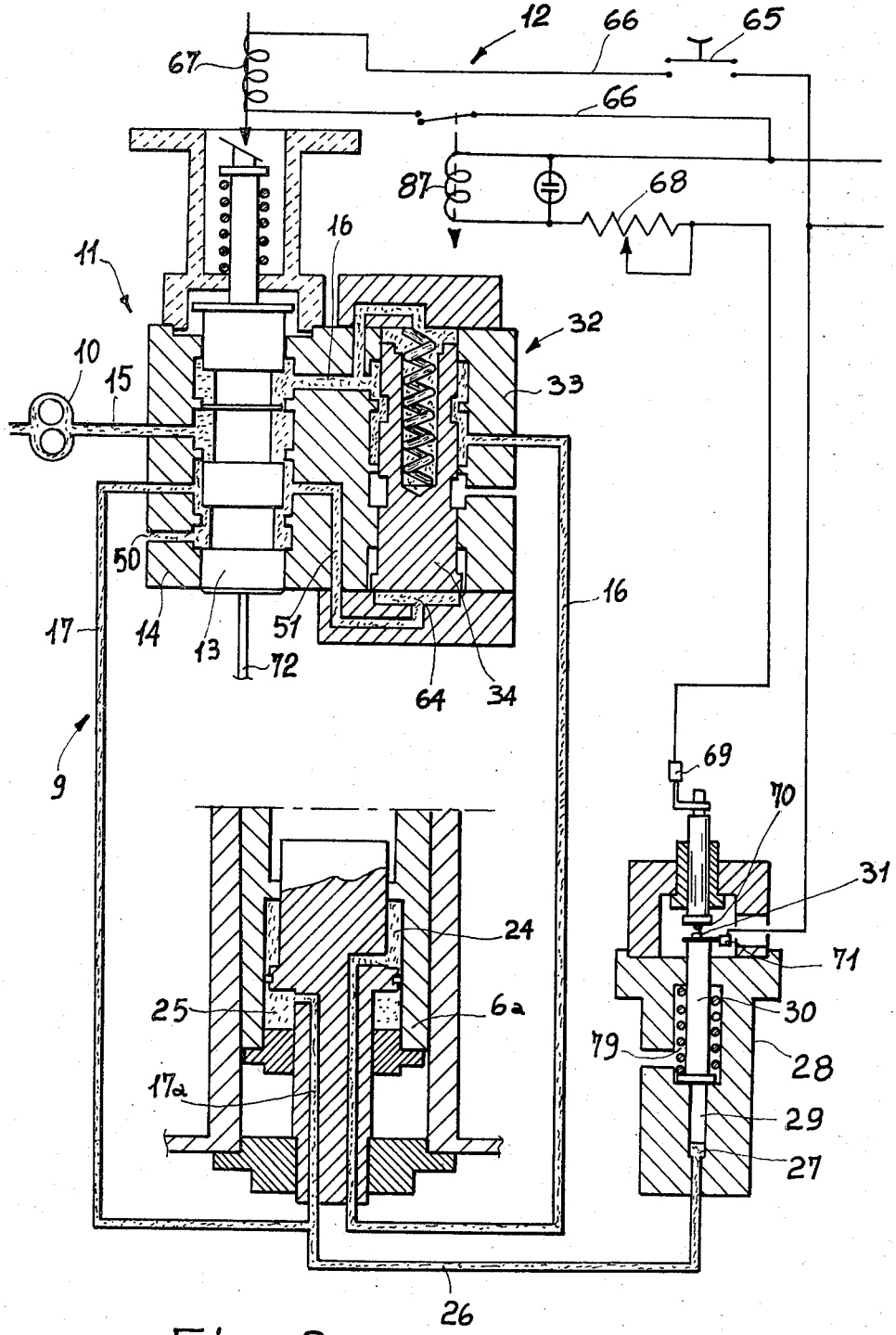
FIG. 2 is a schematic diagram of the device in this invention with the relevant electric control means, in the flag-supporting phase.

Finally, in FIGS. 1 and 2, the flag return stroke is stopped when the cable 72, constrained with 72*a* to the seal 13 of the control valve 11 and with the end 72*b* to the pulley 73, integral to the head 7, moves the seal 13 downwards until it takes the position shown in FIG. 2. From the above, it may be noted that the die-cutting machine equipped with the device in this invention can approach the hollow punch very quickly, carry out cutting smoothly and then be relifted at a lower speed than the approach speed. The fact that the lifting speed is lower than that of the approach to the hollow punch does not alone create drawbacks, as, since the operator must at any rate angularly displace the flag, both operations may be carried out simultaneously without prolonging the working time involved.

I claim:

1. Fast head operating device for die-cutting machines, particularly flag type, comprising a hydraulic circuit with one end connected to a feed pump and the other to two cylindrical chambers defined at the base of a column supporting the head of the die-cutting machine, said hydraulic circuit comprising a control valve, interlocked to electric operating means, equipped with a seal which slides into and is engaged in the body of the same valve to form a fluid communication between a feed conduit and a first inlet conduit, which flows into one of said cylindrical chambers for the rise of the column carrying the head of the die-cutting machine and with a second inlet conduit which flows into the other cylindrical chamber for the downstroke of the abovementioned column, characterized by the fact that it comprises a sequence valve, interposed on said first inlet conduit, a further fluid conduit branching from said second inlet conduit, immediately upstream from the respective cylindrical chamber, the latter conduit flowing into a cylindrical chamber into which a small piston slides and is engaged, carrying, at the opposite end, the mobile contact of a pressure switch connected to said electric operating means.

2. Device according to claim 1, characterized by the fact that said sequence valve comprises a seal which slides into and is engaged in a respective valve body to open said first inlet conduit to the relevant cylindrical chamber and, respectively, interrupt feed to said chamber discharging the working fluid contained in the first inlet conduit, the upper part of said seal being provided with a branch of the first inlet conduit foreseen upstream from the sequence valve flows, said seal and said valve body defining, at the base of the seal itself, a cylindrical chamber, fluidly communicated with the control valve by means of a conduit which flows into the body of the control valve at the height of the second inlet conduit.

3. Device according to claim 2, characterized by the fact that said cylindrical chamber defined by the valve body of the sequence valve and the relevant seal has a larger working thrust surface than that foreseen in correspondence with the abovementioned blind hole.

4. Device according to claim 1, characterized by the fact that a common base presents an inside annular protrusion and is closed at the foot by a centre hole to slide into and be sealed on a piston, integral to the upright of the die-cutting machine, said piston being provided with an outside annular protrusion containing a slot housing an annular seal gasket, said outside annular protrusion defining with the closing element said cylindrical chamber connected to the second inlet conduit and with said inside annular protrusion the cylindrical chamber connected to the first inlet conduit.

5. Device according to claims 1 or 4, characterized by the fact that said cylindrical chambers, heading the second inlet conduit, have a larger working thrust surface on the column supporting the head of the die-cutting machine than the corresponding one foreseen in the hydraulic chamber heading said first inlet conduit.

6. Device according to claim 1, characterized by the fact that said electric operating means comprise an electric circuit on which an electromagnet is located which operates movements of the control valve seal, a relay connected to the end of stroke pressure switch to interrupt said circuit under the action of an electric signal determined by the closing of the pressure switch contacts and a potentiometer, preadjustable to the thickness of the leather to be cut, located between said relay and said pressure switch.

* * * * *